US006073370A

United States Patent [19]

Okajima

[11] Patent Number: 6,073,370

[45] Date of Patent: Jun. 13, 2000

[54] SNOWBOARD BOOT POWER LACING CONFIGURATION

[75] Inventor: Shinpei Okajima, Izumi, Japan

[73] Assignee: Shimano Inc., Sakai, Japan

[21] Appl. No.: 09/122,663

[22] Filed: Jul. 27, 1998

Related U.S. Application Data

[63] Continuation-in-part of application No. 09/027,904, Feb. 23, 1998, Pat. No. 5,909,946.

[51] Int. Cl.[7] ..... A43K 11/00; A43B 5/04

[52] U.S. Cl. ..... 36/50.1; 36/50.5; 36/92; 36/89

[58] Field of Search ..... 36/50.1, 51, 56, 36/89, 92, 170

[56] References Cited

U.S. PATENT DOCUMENTS

| | | | |
|---|---|---|---|
| 2,539,026 | 1/1951 | Mangold | 36/50.1 |
| 3,377,721 | 4/1968 | Johnson | 36/50.1 |
| 5,042,120 | 8/1991 | Nichols | 36/50.1 |
| 5,184,378 | 2/1993 | Batra | 36/50.1 |
| 5,271,130 | 12/1993 | Batra | 36/50.1 |
| 5,345,697 | 9/1994 | Quellais | 36/50.1 |
| 5,377,430 | 1/1995 | Hatfield et al. | 36/51 |
| 5,408,761 | 4/1995 | Gazzano | 36/88 |
| 5,463,822 | 11/1995 | Miller | 36/50.1 |
| 5,564,203 | 10/1996 | Morris | 36/50.1 |
| 5,566,474 | 10/1996 | Leick et al. . | |
| 5,692,320 | 12/1997 | Nichols | 36/51 |

FOREIGN PATENT DOCUMENTS

| | | |
|---|---|---|
| 0 749 702 | 12/1996 | European Pat. Off. . |
| 9-201207 | 8/1997 | Japan . |
| 9-252802 | 9/1997 | Japan . |

*Primary Examiner*—Paul T. Sewell
*Assistant Examiner*—Anthony Stashick
*Attorney, Agent, or Firm*—Shinjyu An Intellectual Property Firm

[57] ABSTRACT

The invention relates to a shoe lacing configuration for an article of footware such as a boot, where the boot is provided with two rings, one ring supported on either side of the boot proximate an ankle supporting portion of the boot. A long strap is looped through the two rings such that the long strap defines an elongated C-like shape. Each end of the long strap is formed with eyelets. A lace extends through eyelets formed in the boot in a traditional criss-cross manner, and the lace further extends through the eyelets formed in the long strap. The long strap has the effect of doubling the force applied to the lace in a manner similar to that of a block and tackle thus improving the lace tightening characteristics of the boot.

7 Claims, 12 Drawing Sheets

SNOWBOARD BOOT POWER LACING CONFIGURATION

This application is a continuation-in-part of U.S. Ser. No. 09/027,904, filed Feb. 23, 1998, now U.S. Pat. No. 5,909, 946 issued Jun. 8, 1999.

BACKGROUND OF THE INVENTION

A. Field of the Invention

The invention relates to a lacing configuration for footwear and in particular to a lacing configuration for a snowboard boot.

B. Description of the Related Art

The laces on boots and large articles of footwear generally are difficult to tighten, especially when wet.

Boots are usually formed with a sole and an upper portion. The upper portion is usually made of a pliable material such as leather or a leather-like material. The upper portion is usually formed with central opening. A tongue is formed on a lower end of the opening, the tongue extending between the sides of the opening. The sides of the opening are usually formed with loops or eyelets through which a lace extends. The lace typically extends through the loops or eyelets in a criss-cross manner, going from side to side through the loops and eyelets. Typically the eyelets or loops are formed on opposite sides of the opening in equal numbers at equally spaced apart intervals, defining pairs of eyelets or loops.

When putting the boots on, the lower portions of the laces must typically be pulled tight near eyelets or loops separately from the tightening of the ends of the lace. For example, a large boot typically has seven or eight pairs of eyelets or loops through which the lace extends. Often a boot user must pull portions of the lace near a second or third set of eyelets tight and then successively move up the pairs of eyelets, grab the corresponding portions of the lace and tighten it further until the top or ends of the lace are finally tightened. Such an operation is particularly difficult if the boot and lace are wet from prior usage of the boot. Whether the lace is wet or dry, the criss-cross configuration of the lace and friction make it very difficult to tighten the lace easily.

SUMMARY OF THE INVENTION

One object of the present invention is to provide an article of footwear with a lace configuration which is easier to tighten.

Another object of the present invention is to provide an article of footwear with a lacing system which provides a more secure engagement with a foot.

In accordance with one aspect of the present invention, an article of footwear is formed with a sole portion made of a sole forming material and an upper portion adhered to the sole portion. The upper portion is formed with a generally central extending tongue portion on an upper surface thereof. The upper portion has a first side portion adjacent to the tongue portion formed with a plurality of eyelets and a second side portion adjacent to the tongue portion formed with a plurality of eyelets. A pair of rings is supported on opposite sides of the upper portion proximate an ankle supporting portion of the upper portion. A long strap extends through the pair of rings defining a C-like shape. A first end of the long strap is formed with a first pair of eyelets and a second end of the long strap is formed with second pair of eyelets. A lace extends in a criss-cross manner through the first and second pairs of eyelets in the long strap and the eyelets in the first and second side portions of the upper portion for tightening the article of footwear on a foot. The long strap for provides leverage to the lace for tightening the article of footwear on the foot.

Preferably, the long strap extends around the upper portion proximate the ankle supporting portion of the upper portion.

Preferably, the pair of rings are supported on opposite sides of the upper portion via a support strap. Further, the support strap is formed with first and second legs. The first leg wraps around a rear portion of the upper portion, and the second leg wraps under a heel supporting portion of the upper portion. The rings extend through a loop formed in corresponding ends of the support strap.

Preferably, the article of footwear includes a second pair of rings fixed to the upper portion proximate a toe supporting portion of the upper portion. A second long strap extends through the second pair of rings and extends across the toe supporting portion of the upper portion.

Preferably, the second pair of rings are supported on opposite sides of the upper portion via a second support strap. The second support strap wraps under a toe supporting portion of the upper portion. The second pair of rings extends through a loop formed in corresponding ends of the second support strap.

The long strap and the second long strap provide a more reliable means for lacing a boot or article of footwear. The long strap proximate the ankle supporting portion of the upper portion may be used with a conventional lacing system or may be used with a conventional lacing system in combination with the second long strap to provide additional lacing advantages.

These and other objects, features, aspects and advantages of the present invention will become more fully apparent from the following detailed description of the present invention when taken in conjunction with the accompanying drawings where like reference numerals denote corresponding parts throughout.

DESCRIPTION OF THE PREFERRED EMBODIMENTS

Figure 1:
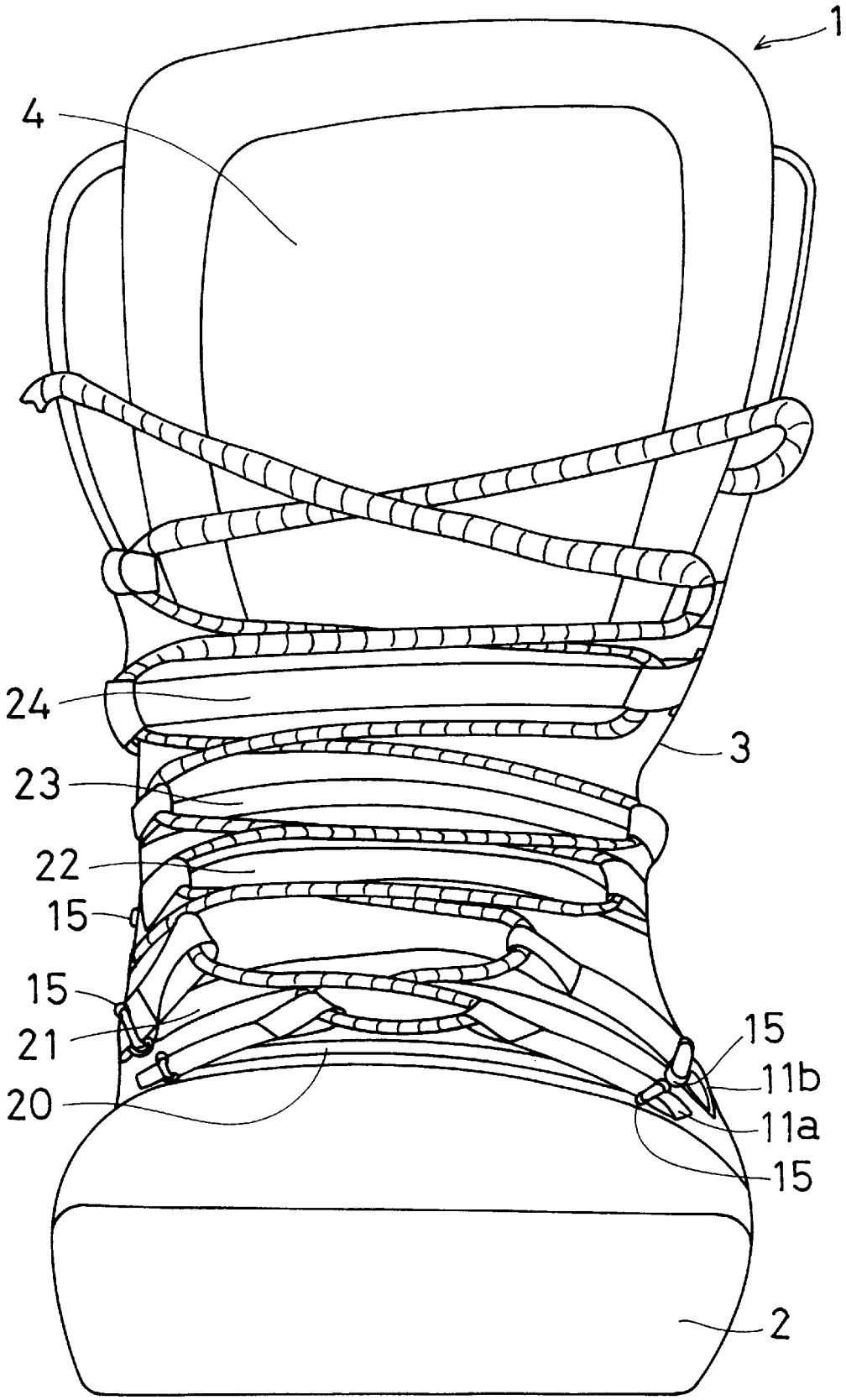
FIG. 1 is a front view of a boot having a double lacing configuration in accordance a first embodiment of the present invention, where a long lace extends through rings of a plurality of straps.
Figure 2:
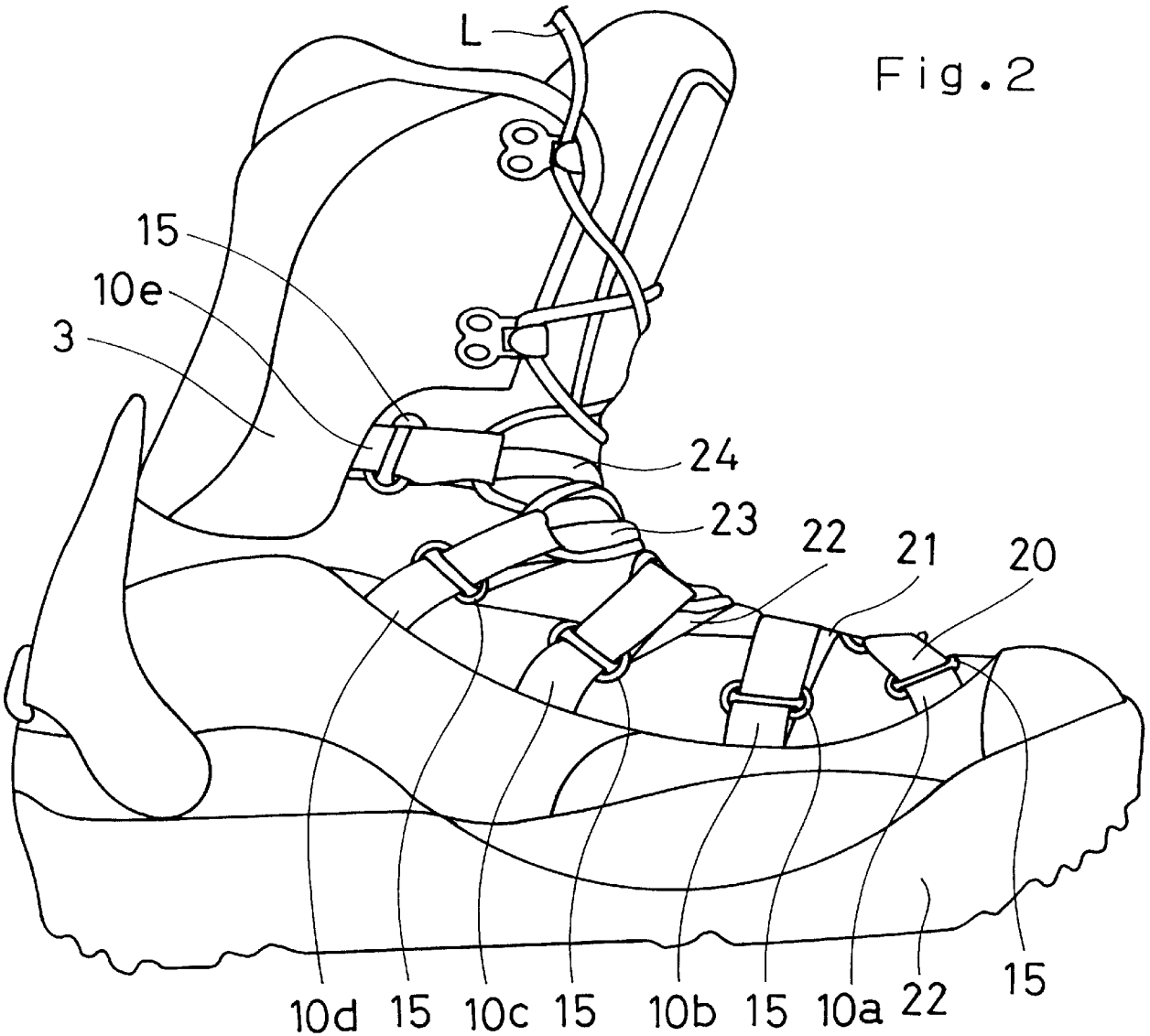
FIG. 2 is a side view of the boot depicted in FIG. 1.

A boot 1 is shown in FIG. 1 which includes a power lacing configuration in accordance with a first embodiment of the present invention. The boot 1 shown in FIGS. 1 and 2 is a snowboard boot. However, the lacing configuration in accordance with the present invention may be employed on any of a variety of boots or footwear. For instance, the lacing configuration could be used on running shoes, bicycle racing shoes, hiking boots, ski boots, snowboard boots or others.

The boot 1 includes a sole portion 2 made of a sole forming material and an upper portion 3 adhered to the sole portion 2. The upper portion 3 is formed with a generally central extending tongue portion 4 which extends between sides of an opening formed in the upper portion 3. Each side of the upper portion 3 is formed with a plurality of short straps. The short straps are divided into two sets of straps, a first set of short straps 10*a*, 10*b*, 10*c*, 10*d* and 10*e* and a second set of short straps 11*a*, 11*b*, 11*c*, 11*d* and 11*e*. The first set of short straps are fixed to a lower edge of a first side of the upper portion 3, and the second set of short straps are fixed to a lower edge of a second side of the upper portion 3, as shown in FIGS. 1 and 2.

The short strap 10*a*, and the short strap 11*a* are positioned at corresponding locations on the first and second sides of the upper portion 3. Similarly, the short strap 10*b* and the short strap 11*b* are positioned at corresponding locations on the first and second sides of the upper portion 3. Similarly, all the other short straps of the first set of short straps (10*c*, 10*d* and 10*e*) and the second set of short straps (11*c*, 11*d* and 11*e*) are positioned at corresponding locations on the first and second sides of the upper portion 3. All of the short straps of the first set of straps 10*a*, 10*b*, 10*c*, 10*d* and 10*e* and of the second set of straps 11*a*, 11*b*, 11*c*, 11*d* and 11*e* are spaced apart from each other by predetermined intervals which may vary depending on the footwear application.

It should be appreciated that the number of short straps in each of the first and second set of short straps may vary. In the preferred embodiment depicted five short straps are included in each of the first and second sets of short straps. However the number of short straps in each set may be less or more depending on the type of footwear on which the lacing configuration of the present invention is to be employed. For example, only one short strap on each side of a shoe could be utilized, especially if the shoe is small. On a pair of running shoes, perhaps each of the first and second sets of short straps might have only two or three short straps. However, on a pair of boots, for instance, hiking boots, ski boots or the snow board boots depicted in FIGS. 1 and 2, five short straps in each of the first and second sets of short straps is the preferred embodiment.

Each of the short straps in the first and second sets of short straps are formed with a loop at an end thereof. A ring 15 extends through each end loop of short straps 10*a*, 10*b*, 10*c*, 10*d*, 10*e*, 11*a*, 11*b*, 11*c*, 11*d* and 11*e*.

A first long strap 20 extends through the ring 15 of the short strap 10*a* and further extends through the ring 15 of the short strap 11*a*. The first long strap 20 has loops formed at each end thereof. A second long strap 21 extends through the ring 15 of the short strap 10*b* and further extends through the ring 15 of the short strap 11*b*. The second long strap 21 has loops formed at each end thereof.

A third long strap 22 extends through the ring 15 of the short strap 10*c* and further extending through the ring 15 of the short strap 11*c*. The third long strap 22 having loops formed at each end thereof. A fourth long strap 23 extends through the ring 15 of the short strap 10*d* and further extends through the ring 15 of the short strap 11*d*. The fourth long strap 23 has loops formed at each end thereof. A fifth long strap 24 extends through the ring 15 of the short strap 10*e* and further extends through the ring 15 of the short strap 11*e*. The fifth long strap 24 has loops formed at each end thereof.

A lace L extends in a criss-cross manner through the loops formed in the first, second, third, fourth and fifth long straps 20, 21, 22, 23 and 24, respectively, for tightening the article of footwear on a foot. The first second, third, fourth and fifth long straps 20, 21, 22, 23 and 24 provide leverage to the lace for tightening the article of footwear on the foot.

It should be appreciated, that the number of long straps 20, 21, 22, 23 and 24 corresponds to the number of straps in each set of short straps. Specifically, in the depicted embodiment there are five long straps 20, 21, 22, 23 and 24. The five long straps extend through the five short straps in the first set of short straps 10*a*, 10*b*, 10*c*, 10*d* and 10*e* and through the five short straps in the second set of short straps 11*a*, 11*b*, 11*c*, 11*d* and 11*e*. The long straps further extend over the opening in the upper portion 3 and across the tongue 4. In other shoe applications, the number of long straps 20, 21, 22, 23 and 24 could be varied. As was discussed above with respect to the short straps, in a small shoe application only one long strap 20 might be required. In a running shoe or bicycling shoe, two or three long straps might be employed. The five long straps 20, 21, 22, 23 and 24 are believed to be the optimal number of long straps for a snowboard boot such as that depicted in FIGS. 1 and 2.

In the lacing configuration of the present invention, the rings 15 are preferably made of metal, specifically a plated steel or stainless steel to reduce friction contact between the long straps 20, 21, 22, 23 and 24 and the rings 15. However, the rings 15 could be made of any of a variety of materials such as brass, plastic, etc. Further, the rings 15 could be replaced with connectors, such as a riveted connector with a loop formed on the end through which the long straps 20, 21, 22, 23 or 24 may extend. The connectors could be riveted to the ends of the short straps 10*a*–10*e* and 11*a*–11*e*.

Figure 5:
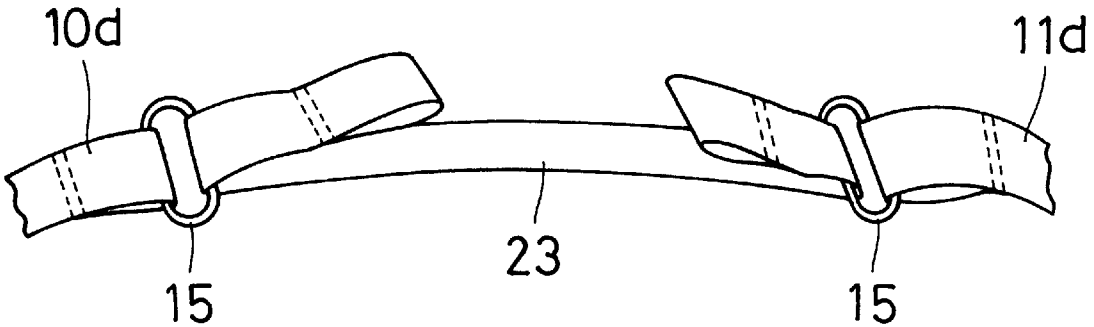
FIG. 5 is a front perspective view similar to FIG. 4, showing a single strap of a boot in accordance with the first embodiment of the present invention.

In FIG. 5, the configuration of the long strap 23 is shown in greater detail with the boot 1 and other straps removed. The shape and configuration of the long strap 23 is generally the same as the other long straps 20, 21, 22 and 24 except that the length of the long straps vary. Specifically, the long strap 20 is the shortest of the long straps. Long strap 21 is longer that long strap 20, strap 22 is longer that strap 21, strap 23 is longer that strap 22 and long strap 24 is longer that strap 23. Other than length, each of the long straps 20, 21, 22, 23 and 24 is generally configured uniformly.

Figure 3:
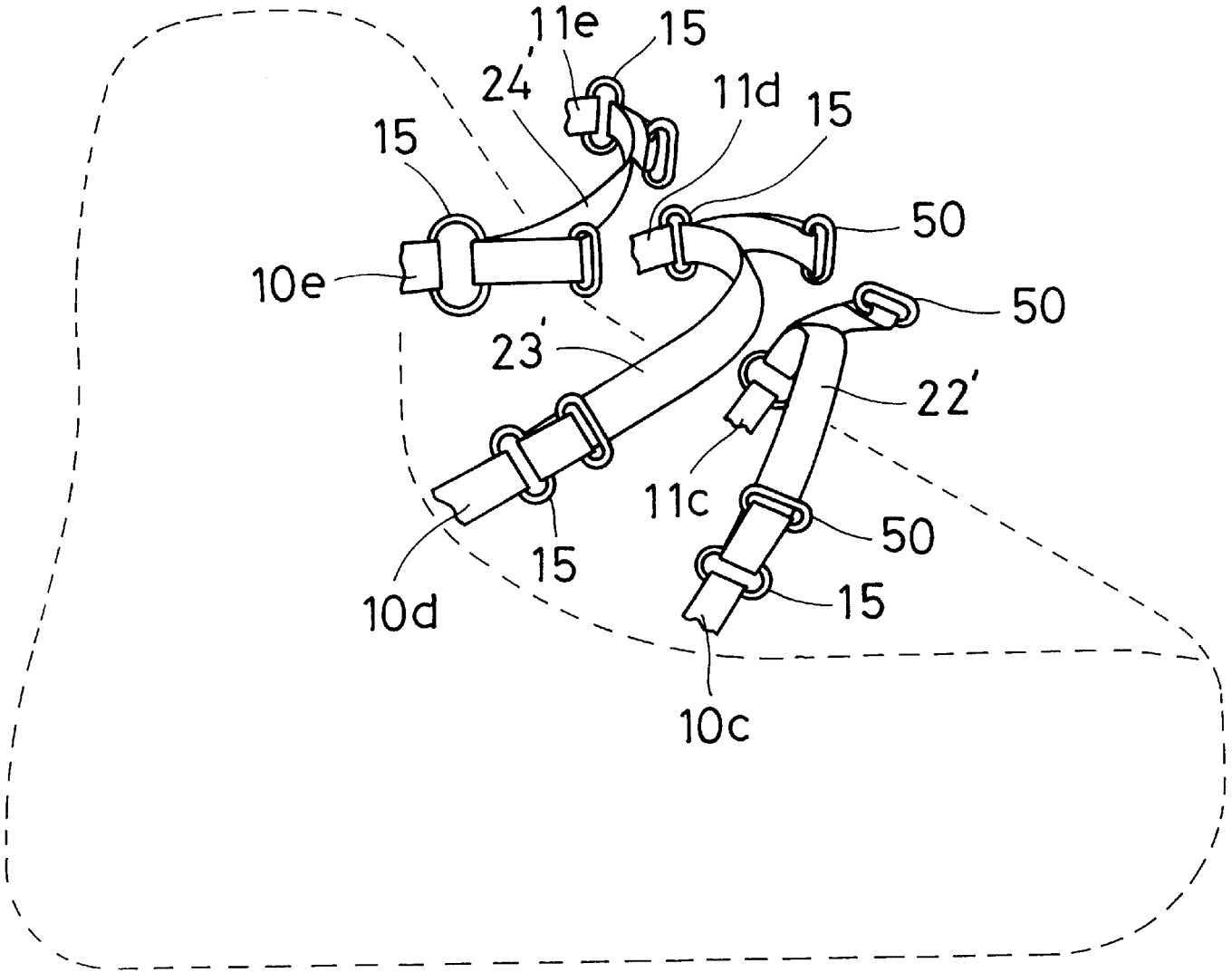
FIG. 3 is a side perspective view of several straps similar to the straps of the boot depicted in FIGS. 1 and 2, with the lace removed to provide greater clarity, in accordance with a second embodiment of the present invention.
Figure 4:
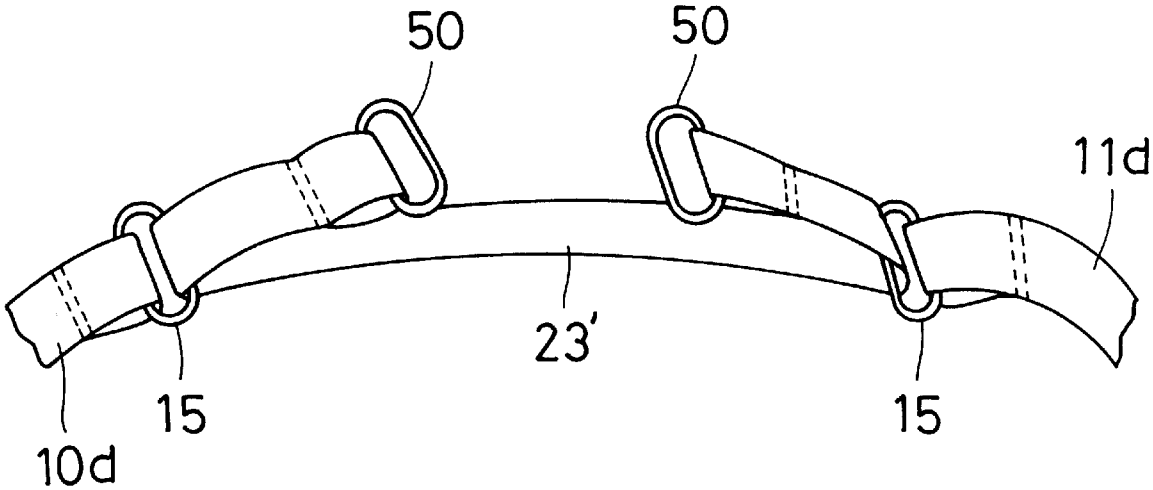
FIG. 4 is a front perspective view of a single strap of the boot depicted in FIG. 3, with the boot, the lace and other straps removed to provide greater clarity.

The lace L extends in a criss-cross manner through the loops formed in the ends of the first, second, third, fourth and fifth long straps 20, 21, 22, 23 and 24. However, in an alternate embodiment In FIGS. 3 and 4 a second embodiment of the present invention is depicted. In the second embodiment, the long straps 20, 21, 22, 23 and 24 are formed with loops and each end thereof, and further includes a separate connector or separate ring 50. The separate rings 50 may be generally the same type of ring or connector as the ring 15. The lace L extends through the separate rings 50 in a manner similar to the way the lace L extends through the loops of the long straps in the first embodiment.

Figure 6:
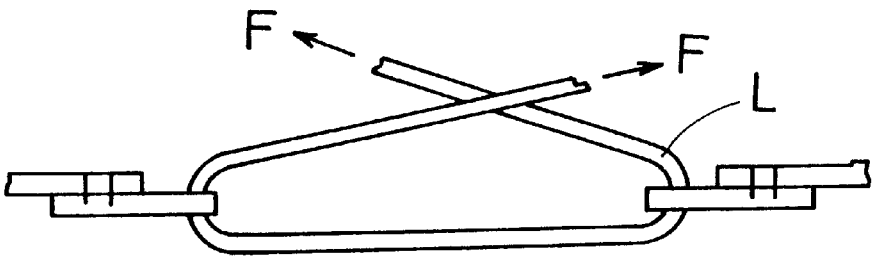
FIG. 6 is an end view of portion of a prior art boot lacing configuration.

As shown in FIG. 6, traditional prior art lacing configurations have a lace extending through apertures formed in the sides of an upper shoe portion. A force F applied to the lace causes the lace to be pulled through the apertures for tightening. Any resistance or friction in the aperture with respect to the lace causes the lace to become difficult to tighten. Further, the force F itself contributes to the creation of friction.

Figure 7:
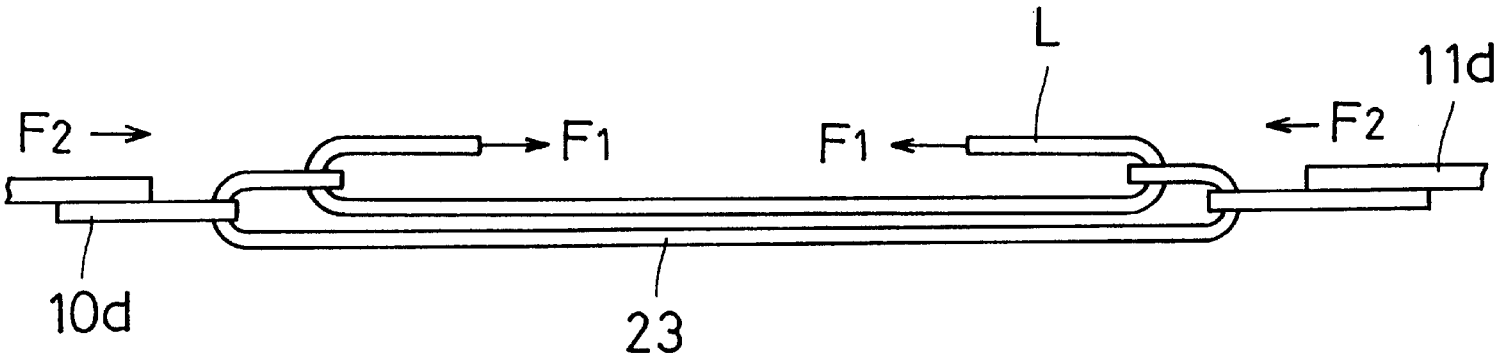
FIG. 7 is an end view of a portion of a boot using the lacing configuration in accordance with the present invention.

In the present invention, as depicted in FIG. 7, the force F1 applied to the long strap 23 is further applied to the short straps 10*d* and 11*d* and is amplified in a manner similar to a block and tackle in that the movement of the long strap 23 is half that of the lace L due to the configuration of the long strap 23 through the ends of the short straps 10*d* and 11*d*. Further, the force F1 is amplified such that a force F2 acting on the short straps 10*d* and 11*d* is generally twice the force F1.

Figure 8:
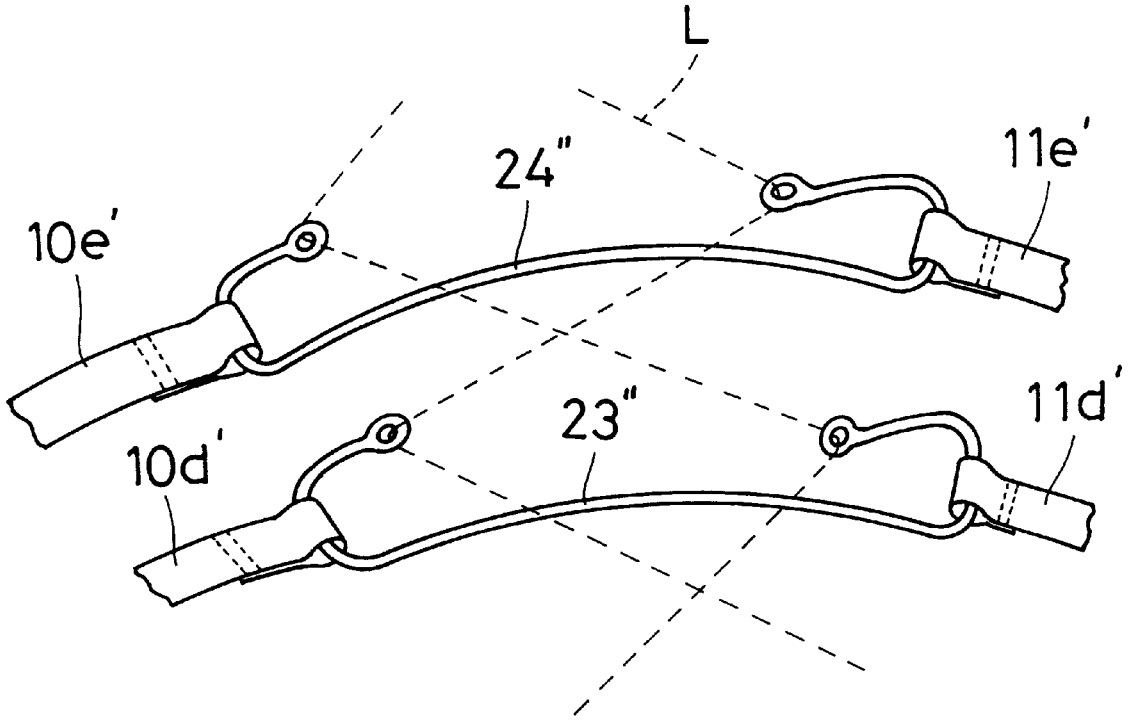
FIG. 8 is a front view similar to FIGS. 4 and 5, showing short straps and long straps in accordance with a third embodiment of the present invention.

A third embodiment of the present invention is depicted in FIG. 8. In FIG. 8, long straps 23" and 24" extend through loops formed in the short straps 10*d*′, 10*e*′, 11*d*′ and 11*e*′. A lace L further extends through loops formed in the long straps 23" and 24". In the third embodiment, the rings 15 are completely eliminated. All of the long and short straps of the present invention can similarly be configured with loops and ends thereof thus eliminating the need for the rings 15.

Figure 9:
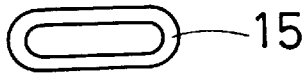
FIGS. 9, 10, 11 and 12 are front views of various rings that may be employed in the first and second embodiments of the present invention.
Figure 10:
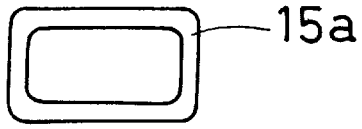
Figure 11:
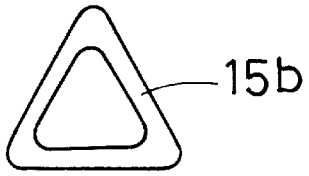
Figure 12:
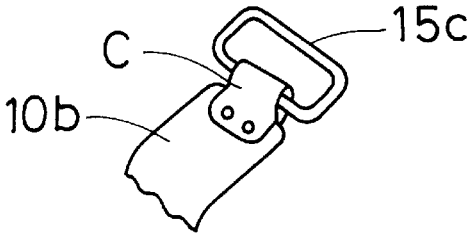
Figure 13B:
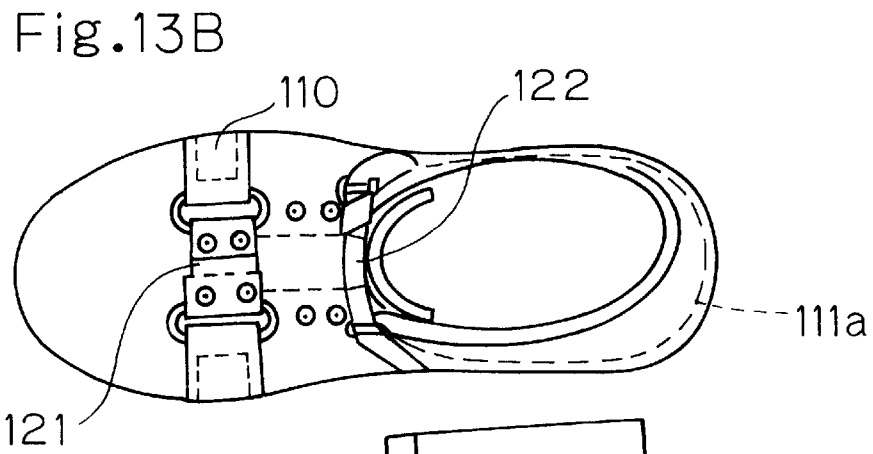
FIGS. 13A, 13B and 13C are side, top and front views, respectively, of a boot in accordance with a fourth embodiment of the present invention.
Figure 13A:
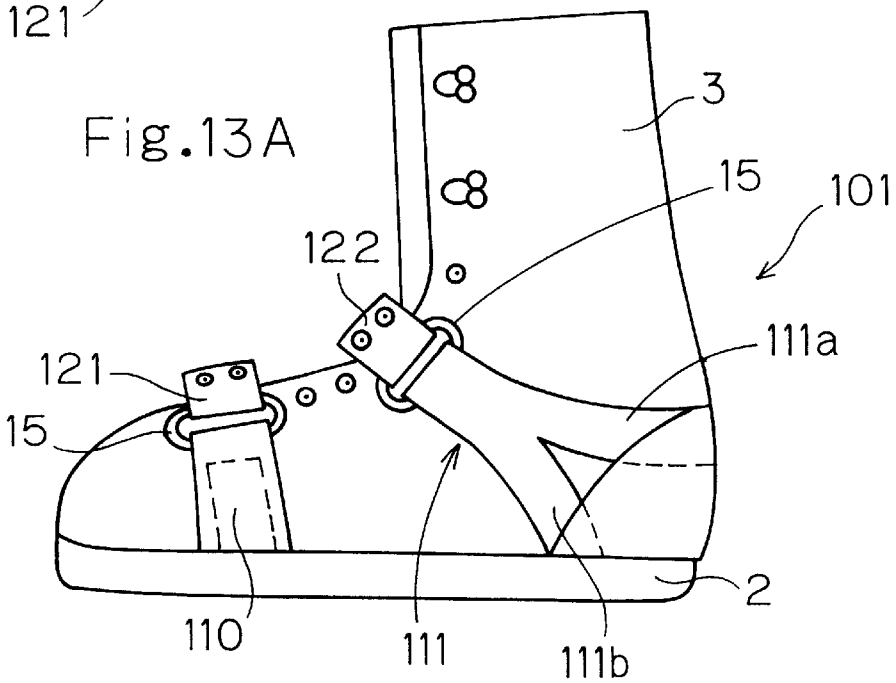
Figure 13C:
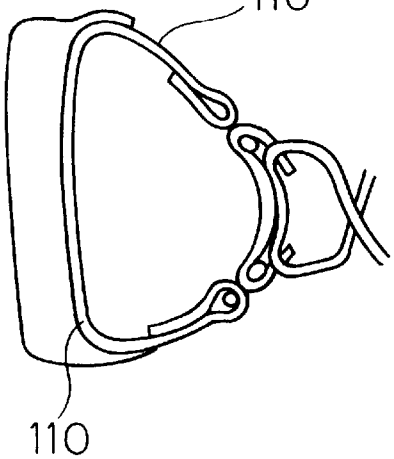

One ring 15 is depicted in FIG. 9, shown removed from the boot 1. The ring 15 also represents the rings 50 in that the rings 15 and 50 need not be the loop as depicted in FIG. 9. Alternatively, the rings 15 and 50 could be shaped with a more rectangular shape such as the ring 15*a* depicted in FIG. 10. Further, the rings 15 and 50 might also be replaced with the triangular shaped connecter 15*b*. As well, the rings 15 and 50 could be replaced with the connector 15*c* depicted in FIG. 12. The connector 15*c* includes a ring and a connector portion C which is riveted to, for example, the short strap 10*b*.

Figure 14:
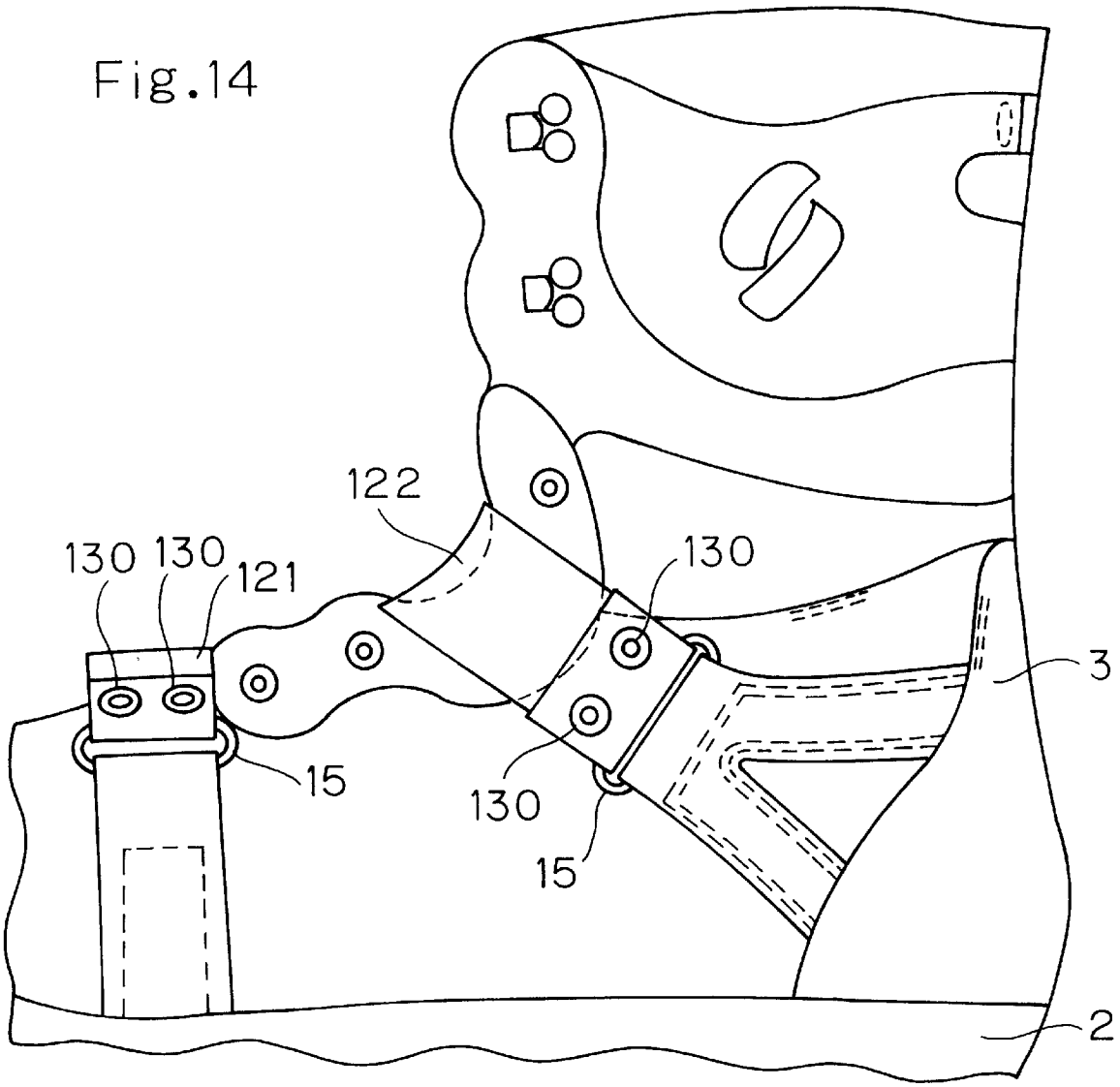
FIG. 14 is a side view, similar to FIG. 13A, on an enlarged scale, showing further details of straps on the boot in accordance with the fourth embodiment.
Figure 15:
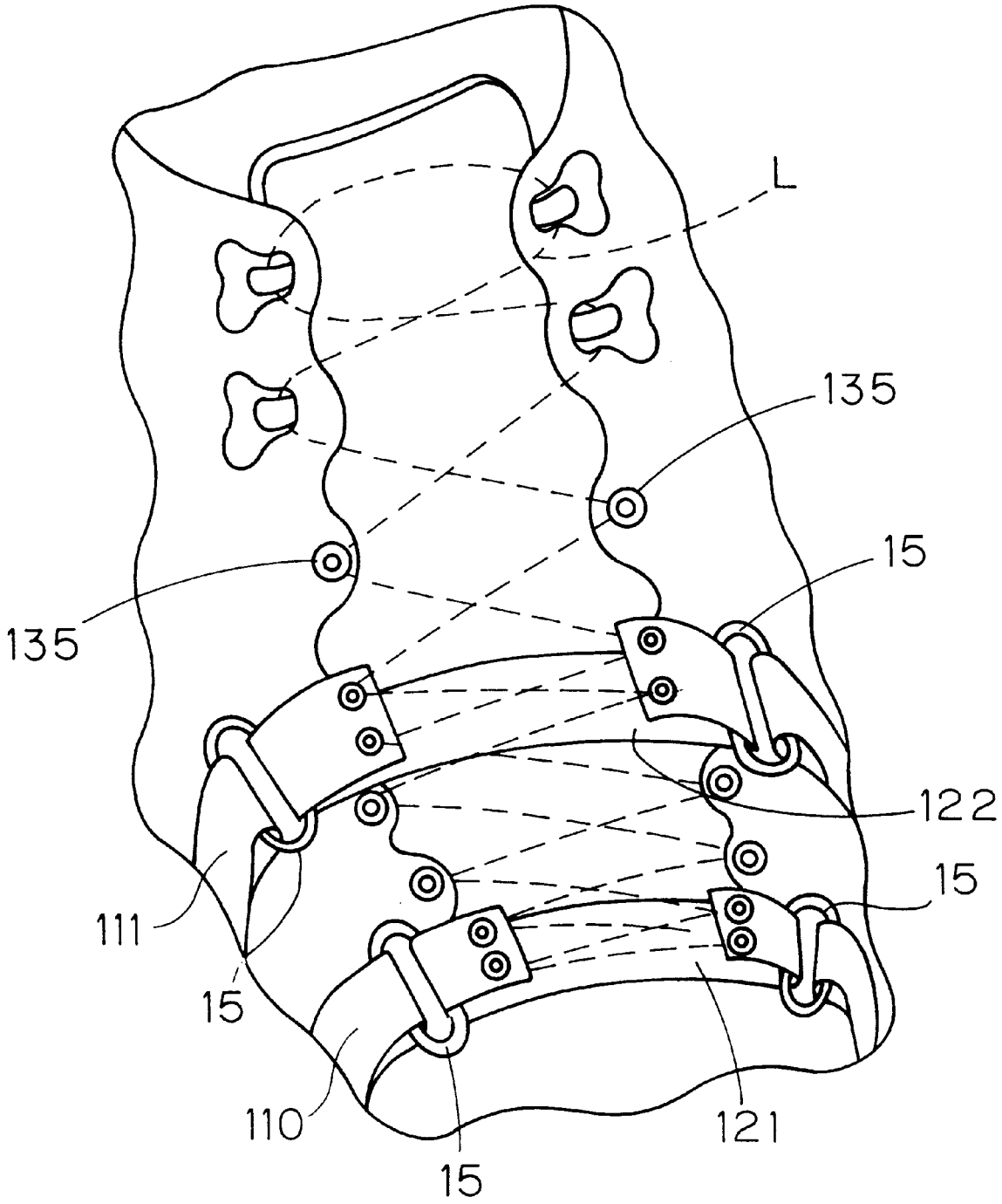
FIG. 15 is a fragmentary perspective view showing a lace extending through eyelets formed in the straps and eyelets formed in the boot.

In a fourth embodiment, depicted in FIGS. 13A, 13B, 13C, 14 and 15, a boot 101 is formed with a sole portion 2 and an upper portion 3. A strap 110 fixed to the upper portion 3 by stitches and/or adhesives. The strap 110 wraps all the way around the portion of the boot 101 which supports the foot of a boot wearer, thus providing firm engagement between the foot and the boot. In other words, the strap 110 wraps all the way around a foot (not shown) inserted into the boot 101. Similarly another strap 111 is also fixed to the upper portion 3 of the boot 101. The strap 111 includes a first leg portion 111*a* and a second leg portion 111*b*. The first leg portion 111*a* extends around the upper portion 3 of the boot 101 to provide support around the heel or backside of a foot (not shown) inserted into the boot 101. In a manner similar to the strap 110, the second leg portion 111*b* of the strap 111 extend under the upper portion 3 of the boot 101 and thus extends under the heel of a foot (not shown) inserted into the boot 101. Each end of the first and second straps 110 and 111 are looped around a portion of corresponding rings 15, as depicted in FIGS. 14 and 15.

The boot 101 also includes a long straps 121 and 122. The long straps 121 and 122 extend though rings 15 in a manner similar to that described above with respect to the first embodiment. The rings 15 extend through loops formed on the ends of straps 110.

Referring to FIG. 14, the straps 121 and 122 are each formed with a pair of eyelets 130 at each end thereof. A lace L, as shown in FIG. 15, extends between the eyelets 130 and eyelets 135 formed in the sides of the boot. The pair of eyelets 130 formed on each end of each of the straps 121 and 122 provide an additional advantage over the first embodiment of the present invention in that the straps 121 and 122 are better retained in position and do not twist or loose shape easily. This provides better support for the foot in the boot 101. Further, the configuration of the fourth embodiment makes it easier to insert and remove the foot from the boot 101 since unlacing the boot 101 is easier than in the prior art. The position of the strap 122 is proximate the ankle and therefore provides firm support for the foot in the boot thus improving steering control when the boot is used for snowboarding, skiing or other similar sport.

Figure 16:
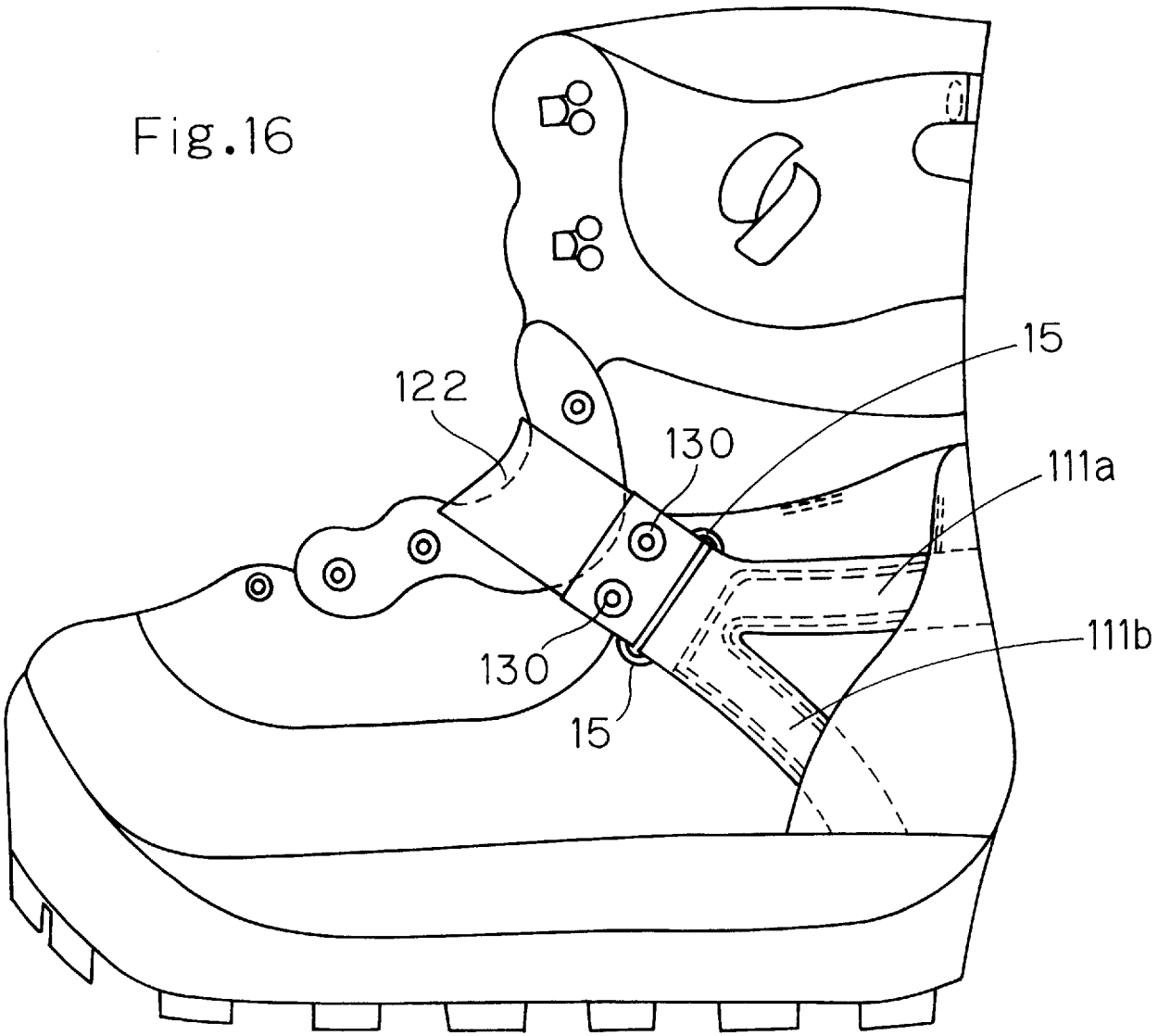
FIG. 16 is similar to FIG. 14 and shows a fifth embodiment of the present invention.
Figure 17:
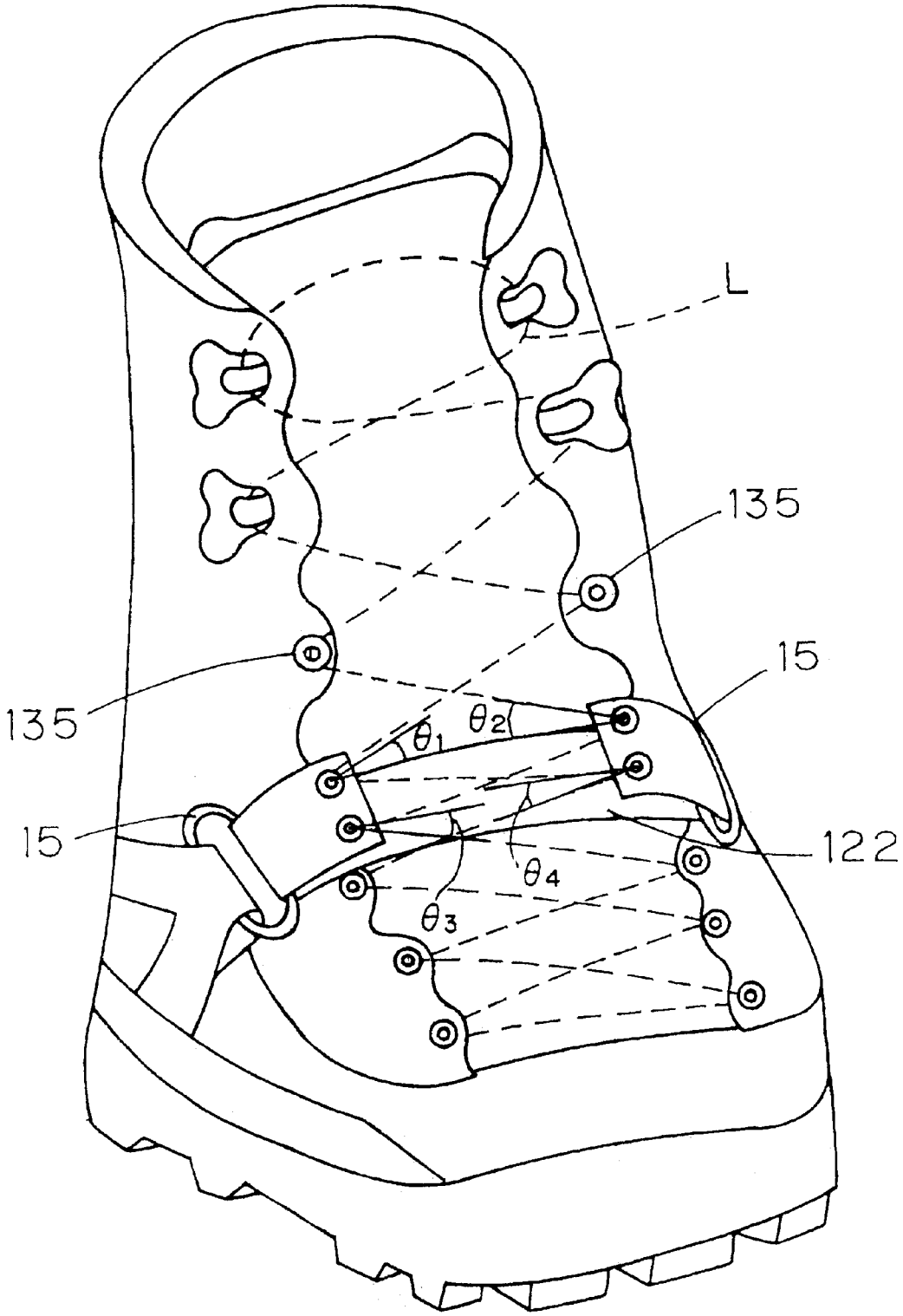
FIG. 17 is a perspective view of an article of footwear in accordance with the fifth embodiment of the present invention.

In a fifth embodiment depicted in FIGS. 16 and 17, the strap 110 and the long strap 121 have been eliminated, when compared to the fourth embodiment. Otherwise, the fifth embodiment depicted in FIGS. 16 and 17 is generally the same as the fourth embodiment described above. Specifically, the fifth embodiment, as shown in FIGS. 16 and 17, includes the strap 122 and the strap 111 with first and second leg portions 111*a* and 111*b*.

It should be understood that in all of the above embodiments, the long straps 21–24, 121 or 122, all define an elongated C-shape, turned on its side when viewed from an end, such as in FIG. 7 where the long strap 23 is depicted.

One advantage of the present invention is that the lace L engages the long straps, for instance, the long strap 122 in FIG. 17, at relatively small angles with respect to the length of the long strap 122. For example, in FIG. 17 angles $\theta_1$, $\theta_2$, $\theta_3$ and $\theta_4$ correspond to angles defined between the lace L and the long strap 122, each angle being measured with respect to the length of the long strap 122. The smaller the angle, the greater the amount of tensile force applied to the long strap 122 from the lace L along the length of the long strap 122. Therefore, with a small angles $\theta_1$, $\theta_2$, $\theta_3$ and $\theta_4$ it is possible to more easily tighten the long strap 122.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A snowboard boot comprising:

a sole portion made of a sole forming material;

an upper portion adhered to said sole portion;

a support strap fixed to the upper portion, said support strap having a first leg portion and a second leg portion, said first leg portion extending around a rear end of said upper portion to provide support around a heel portion of a foot insertable into said boot, said second leg portion extending under said upper portion;

a pair of rings supported on opposite ends of said support strap proximate an ankle supporting portion of said upper portion;

a long strap extending through said pair of rings such that first and second ends of said long strap wrap part way around corresponding ones of said rings thereby extending towards each other, said first end of said long strap being formed with lace engaging means and said second end of said long strap being formed with lace engaging means;

wherein said lace engaging means in said long strap are configured for receiving a lace for tightening said boot on the foot, said long strap for providing leverage to the lace for tightening said boot on the foot thereby securing the fool within the boot such that the foot is pulled back towards a rear portion of said upper portion of said boot due to support from said first leg portion of said support strap and the foot is urged downward by said long strap due to support from said second leg portion of said support strap to restrict movement of the foot with respect to a heel portion of said sole portion of said boot.

2. The snowboard boot as set forth in claim 1, wherein said upper portion is formed with a generally central extending tongue portion on an upper surface thereof, said upper portion having a first side portion adjacent to said tongue portion formed with lace engaging means and a second side portion adjacent to said tongue portion formed with lace engaging means, said lace engaging means in said first and second side portions of said upper portion are configured for receiving the lace for tightening the snowboard boot on the foot.

3. The snowboard boot as set forth in claim 1, wherein said long strap extends around said upper portion proximate the ankle supporting portion of said upper portion.

4. The snowboard boot as set forth in claim 1, further comprising:

a second pair of rings fixed to said upper portion proximate a toe supporting portion of said upper portion;

a second long strap extending through said second pair of rings, said second long strap extending across the toe supporting portion of said upper portion.

5. The snowboard boot as set forth in claim 4, wherein said second pair of rings arc supported on opposite sides of said upper portion via a second support strap, said second support strap wrapping under a toe supporting portion of said upper portion, said second pair of rings extending through a loop formed in corresponding ends of said second support strap.

6. The snowboard boot as set forth in claim 1, wherein said lace engaging means in said long strap comprises eyelets.

7. The snowboard boot as set forth in claim 2 wherein said lace engaging means in said first and second side portions of said upper portion comprises hooks fixed thereto.

* * * * *